United States Patent [19]

Wilk

[11] Patent Number: 4,956,525

[45] Date of Patent: Sep. 11, 1990

[54] ELECTRICAL INSULATING BUSHING ASSEMBLY, KIT FOR PROVIDING SAME, AND METHOD OF INSTALLING SAME

[75] Inventor: Robert J. Wilk, Oak Forest, Ill.

[73] Assignee: G & W Electric Company, Blue Island, Ill.

[21] Appl. No.: 361,416

[22] Filed: Jun. 5, 1989

[51] Int. Cl.[5] ..... H01B 17/26

[52] U.S. Cl. ..... 174/152 R; 29/631

[58] Field of Search ..... 174/18, 31 R, 152 R, 174/153 R, 167; 29/631, 458, 527.2

[56] References Cited

U.S. PATENT DOCUMENTS

| | | | |
|---|---|---|---|
| 2,088,502 | 7/1937 | Arnold et al. | 174/152 R |
| 3,230,301 | 1/1966 | Sonnenberg et al. | 174/152 R X |
| 3,388,211 | 6/1968 | Nichols et al. | 174/152 R |

*Primary Examiner*—Laramie E. Askin

*Attorney, Agent, or Firm*—Fitch, Even, Tabin & Flannery

[57] ABSTRACT

An electrical insulating bushing and a method of fabrication with an electrical device having a cabinet with an outer wall and a bushing-receiving aperture in the wall. The bushing includes an elongated body surrounding a central conductor with an annular mounting flange at a mid portion of the insulator body. An interface collar is received in the aperture of the cabinet and is welded to the cabinet wall. Thereafter, the bushing is inserted in the interface collar and is joined thereto with an adhesive. A gasket ring is positioned between the bushing flange and the interface collar prior to the adhesive joinder thereof, so as to augment the fluid-tight seal therebetween.

36 Claims, 3 Drawing Sheets

ELECTRICAL INSULATING BUSHING ASSEMBLY, KIT FOR PROVIDING SAME, AND METHOD OF INSTALLING SAME

BACKGROUND OF THE INVENTION

1. Field of the Invention

The present invention pertains to high voltage electrical equipment enclosed in a metallic housing and having insulating bushings for high voltage electrical connections extending through the housing.

2. Description of the Related Art

Many types of high voltage electrical equipment in use today have outer metallic structures which serve as a rugged shipping container and which protect the internal components of the electrical device. Due to inefficiencies of practical electrical components, heat is generated within the metallic structure. Accordingly, some means of providing cooling for components internal to the structure must be provided. Of interest here are liquid-filled and gas-filled electrical devices in which the electrical components are totally immersed in a fluid (herein, a non-air fluid) comprising the electrically insulating heat conducting medium. Fluid cooling media are preferred over air-filled equipment, since fluid-cooled devices can be made substantially smaller. It has been found convenient to fashion the outer metallic container as a pressure vessel to provide adequate leak-free containment of the dielectric cooling fluid disposed therein.

High voltage electrical devices, particularly those commonly employed in the electrical power industry, have average life expectancies of several decades. When properly installed, electrical devices of the type referred to herein typically require little or no maintenance during their operating life. Accordingly, in order to prevent unnecessarily premature maintenance operations, an outer metallic structure must be leak-free. This is particularly critical for fluid-filled electrical equipment in which the outer metallic structure is filled with a dielectric gas such as sulphur hexafluoride. In the past, considerable attention has been paid to gaskets of removable doors and the like, and to the leak-free integrity of welding operations used to construct the outer metal closures.

Practical electrical devices must have provision for connecting the internal components thereof to external electrical systems, such as a power distribution system, for example. Electrical components operated at higher voltages require special design considerations for high voltage conductors which pass through a ground plane, such as a side wall of a metal closure. In order to reduce electrical stress at points of close spacing between the high voltage electrical conductor and the grounded closure, electrical insulating bushings are employed to provide an increased dielectric strength. The bushings, typically made of porcelain or an epoxy material, have significant mass and require substantial physical support from the metal closure so as to withstand mechanical stresses due to the weight of the bushing and also the weight of the relatively massive electrical conductors which are fastened to the ends of the bushing so as to receive mechanical support therefrom.

Two modes of mechanically securing a bushing to a metal closure are in popular use today. In a first mode, the bushing is bolted to the metal closure and gasket rings are compressed between the bushing and the wall of the metal closure to provide a fluid-tight seal. In a second type of bushing construction, a metallic flange, is wedded to the bushing insulation body. For example, one type of bushing in use today has a plug-cast epoxy body which is molded around the radially interior portion of an annular metal mounting ring, resembling an annular disk. The radially exterior portions of the mounting ring are left uncovered by the bushing body and provide a convenient flange for welding to the wall of a metal closure. However, as will be appreciated by those skilled in the art, such welding is performed at a relatively close spacing to the molded epoxy body and precautions must be observed to prevent damage to the bushing body caused by the heat of the welding operation. Such welded bushing flanges provide an alternative method to bolted gaskets, and are preferred in certain types of electrical installations today, such as those applications having a gas composition such as sulfur hexafluoride as an insulating medium.

Although precautions are taken during welding, such as providing a heat sink at the radially inner portions of the welding collar, immediately adjacent the dielectric bushing body, deficiencies in the fluid-tight seals of such welded bushing constructions have been observed in long term tests. Even if elaborate precautions are taken during the welding operation, it is possible that the fluid-tight seal between the dielectric bushing body and the metallic welding flange will be compromised during construction of the device. Due to the very long life expectancy of electrical equipment and the relatively high pressures of the dielectric gases which must be contained by the bushings as well as the metal closure, even relatively minor, so called "fine" leaks assume a critical importance. For the purposes herein, a "fine" leak is on of the order of one millionth of a cubic centimeter- atmosphere per second. The epoxy - metal interface of such welded bushings, it is observed, frequently exhibits insidious fine leaks. Significant resources are expended today in testing and returning to the manufacturing facility, bushings found to have fine leaks. In order to improve the economies of operation, it is desirable to provide a bushing which is inherently reliable in its ability to remain leak-free even with respect to fine leaks, over relatively long periods of time.

Occasionally, a number of electrical insulating bushings must be welded to the outer surface of a metal closure, in a high density, closely spaced array. The bushings, when placed close to one another, present difficulties to a manufacturer of electrical equipment in that it is difficult to orient the welding equipment in an optimum manner. For example, bushings having welding flanges formed therewith are inserted through a closure wall, with the welding flange being pressed against portions of the closure wall surrounding a bushing-receiving aperture. Next, the outer periphery of the welding flange is welded to the outer surface of the metal closure. It is generally desirable to orient a welding electrode or the like source of welding heat at a 45° angle to the surface of the metal closure. The welding equipment is preferably revolved in a circle concentric with that of the bushing. However, when the bushings are closely spaced together, and extend significant distances outwardly beyond the wall of the metal closure, adjacent bushings tend to obstruct the welding equipment, and the desired 45° orientation is not possible. This results in time consuming adjustments necessary to complete the welding operation.

SUMMARY OF THE INVENTION

It is an object according to the present invention to provide a bushing and a method of installing the bushing in the wall of a metal closure or the like.

Another object according to the present invention is to provide a bushing and a method of mounting the bushing to a metal surface with a metallic welding flange, while avoiding problems such as heat induction into the bushing body and difficulties in fabricating equipment with high density, closely spaced bushings, as has been experienced with welded bushing flanges.

A further object according to the present invention is to provide a bushing having a metallic mounting collar in which the flange can be easily welded to a metal surface, regardless of the density of bushings or other obstructions in the immediate area of the welding operation.

Another object of the present invention is to provide a bushing with reduced electrical stress concentration.

These and other objects according to the present invention, which will become apparent from studying the appended description and drawings, are provided in a method of installing an electrical insulating bushing in an electrical component having at least one outer metallic wall defining a bushing-receiving aperture, comprising the steps of: providing a bushing having a body with opposed ends and terminals at each end; providing an external flange of electrical insulating material outwardly extending from said bushing body and located intermediate the ends thereof; providing a metallic interface collar or mounting collar having a mating face for engaging said bushing external flange and an internal wall defining an aperture for telescopically receiving a portion of the bushing; welding said mounting collar to said component wall; providing an annular gasket; coating adhesive on at least one of said bushing and said mounting collar; inserting said gasket between said bushing flange and said mounting collar; inserting one end of said bushing through said mounting collar; pressing said bushing flange against said mounting collar to compress said gasket therebetween to join said bushing and said mounting collar together and to form a fluid-tight seal therebetween; and allowing said adhesive to cure so as to maintain the joinder and the fluid-tight seal between said bushing flange and said mounting collar.

The mounting collar, according to other aspects of the present invention, is relatively flexible so as to withstand the repeated bending and flexures of the cabinet wall to which it is welded, caused by pressure variations within the cabinet, without compromising the fluid-tight, pressure-tight seal thereof with the bushing and cabinet wall.

Other objects and advantages of the present invention are attained in a housing assembly for an electrical component comprising: a closure for at least partly enclosing an electrical component immersed in a dielectric fluid and said closure having an external metallic wall defining an aperture through which an electrical insulating bushing can be inserted; an electrical-insulating bushing having a body with opposed ends, one of which is disposed within said closure and electrical terminals at each end; a metallic mounting collar having an internal wall defining a central bushing-receiving passageway, a mating face and an opposed closure-engaging face, said collar welded to said closure metallic wall; a flange of insulating material outwardly extending from the bushing and pressed against said mounting collar; a resilient gasket between said bushing flange and said mounting collar; a first portion of said bushing extending through said mounting collar and said metallic wall; and an adhesive coating joining said bushing flange and said mounting collar together so as to maintain a compression of said gasket between said bushing flange and said mounting collar mating face and so as to form a fluid-tight seal therebetween.

Further objects and advantages of the present invention are provided in a kit for providing an electrical-insulating bushing in an aperture of an external metallic wall of a fluid-containing enclosure of an electrical device immersed in a dielectric fluid, comprising; a metallic mounting collar for welding to portions of the outer metallic wall of the enclosure surrounding said aperture and having an internal bushing-receiving passageway with internal threads; a bushing having an insulating body with opposed ends, electrically-conducting terminals at each end, an outwardly extending flange with a mating face intermediate the ends, a gasket-receiving recess in said flange extending from the mating face thereof, and external threads formed on an outside surface of said bushing intermediate the ends thereof and adjacent the flange thereof; a resilient gasket dimensioned to be at least partially received in said flange recess; and an adhesive for joining the bushing flange and the mounting collar together after welding of said collar to the enclosure wall, so as to form a fluid-tight seal therebetween.

Each of the above embodiments of the invention may have smooth bore mounting collars or, alternatively, may have internally threaded collars for engaging threaded external surface portions of a bushing, such portions preferably being located adjacent the bushing mounting flange, so as to draw the mounting flange into compressive engagement with the mounting collar, thereby providing a preferred anaerobic environment for curing of the preferred anaerobic adhesive. According to other aspects of the present invention, exposed surfaces of the mounting collar, which preferably is made of metal, act as a catalyst for the preferred anaerobic adhesive. In each of the above embodiments, it is generally preferred that both the bushing body outer surface, whether threaded or not, and the face of the bushing mounting flange engaging the mounting collar, both be continuously coated with an adhesive or the like fluid-tight sealing agent, so as to present a relatively long path length of continuous fluid-tight sealing so as to resist fluid leakage therethrough.

Also, each of the above embodiments according to the present invention may have a two-piece interface or mounting assembly in place of the above-mentioned interface or mounting collar, which preferably has an L-shaped cross-section, comprising a plate extending parallel to the enclosure wall and an annular bushing-engaging member extending therefrom. The two-piece assembly includes a welding disk with a central bushing-receiving aperture and an outer periphery for welding to the enclosure wall. A mounting ring is also included in the assembly. The mounting ring has a central bushing-receiving aperture which may be threaded or unthreaded, but which is adhesively joined to the bushing insulator body in either event.

DETAILED DESCRIPTION OF THE PREFERRED EMBODIMENTS

Figure 1:
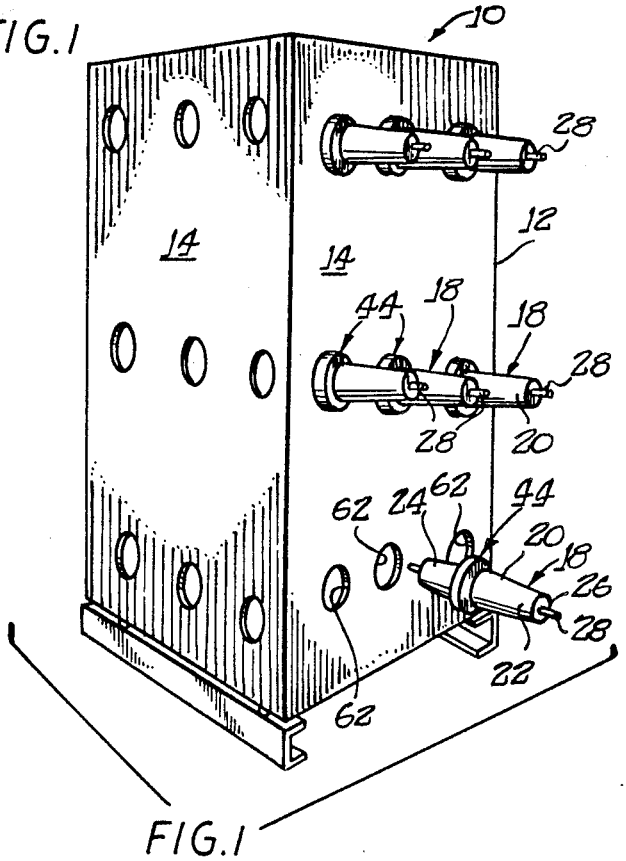
FIG. 1 is a perspective view of an electrical device illustrating aspects of the present invention.

Referring now to the drawings and initially to FIG. 1, an electrical device is generally indicated at 10. The electrical device 10 may comprise any one of a number of electrical devices in common use today. For example, the electrical device 10 is illustrated in FIG. 1 as a vault-style fluid insulated switch, preferably of the gas insulated type which provides efficient space utilization for use in cramped quarters The electrical device 10 includes a metallic outer cabinet 12 having a plurality of upstanding side walls 14 and opposed upper and lower end walls (not visible) forming a gas-tight enclosure. Conventional electrical switchgear components are installed within cabinet 12 and include live electrical conducting parts.

Although the present invention has found immediate acceptance in the field of high voltage power class electrical equipment such as that used in electrical power transmission and distribution, many other types of electrical equipment can also benefit from the present invention. For example, many types of electrical test equipment are operated at high voltages and often require an electrical insulating bushing, as do electrical arc furnaces and the various stages of a particle accelerator.

For electrical devices operated at relatively high voltages (several KV and above), special care must be taken in terminating the electrical equipment for connection to an external circuit. In order to make electrical connection to an external operating system such as a utility distribution grid, the electrical components within cabinet 12 must be provided with electrically energized current-carrying conductors which protrude through the metallic cabinet 12. Although a simple aperture could be provided in the side walls 14 of cabinet 12 to accommodate the passage of an electrical conductor therethrough, the size of such aperture would be prohibitively large, especially considering the need to retain an insulating gas or perhaps an insulating liquid within the cabinet.

In order to reduce electrical stress at points where closely spaced conductors are energized at widely differing voltages, a carefully constructed electrical insulating body may be installed around the energized conductor to grade or distribute the electrical field surrounding that conductor. Over the years, such electrical insulating bodies have developed into the well known form of an electrical insulating bushing, such as the bushings 18 illustrated in FIG. 1. The bushings 18 are, in some respects, similar to conventional electrical insulating bushings now employed in many types of electrical high voltage equipment. As mentioned above, the walls through which the bushings penetrate are frequently made of metal, and provide a rugged container protecting the electrical device inside the cabinet while providing an electrical grounding which is advantageous as a safety feature, should personnel inadvertently contact the cabinet.

It has been found convenient to provide an electrical insulating bushing, such as the bushing 18, wherever a high voltage electrical conductor is made to pass through a metallic member such as a grounded cabinet wall. The electrical insulating bushing 18 is therefore provided with a dielectric body 20 which may have a generally hollow, cylindrical configuration but, in the preferred embodiment, has the shape of back-to-back frustoconical body portions 22, 24. The bushings 18 also include a central, axially-extending electrical conductor 26 having terminals 28 at its opposed ends for electrical connection to high voltage circuit components. For example, the terminal located at the interior end of bushing 18 provides electrical connection to the high voltage electrical component housed within cabinet 12, while the terminal 28, located exterior of the cabinet, provides electrical connection to an external circuit such as an electrical lead terminated to a bus bar.

Construction of the dielectric body 20 of the insulator in a manner to control the electrical field surrounding the conductor 26 when energized at a high voltage is well known and will not be discussed here. As will be seen herein, the present invention provides an improved method for mounting electrical insulating bushings to a metallic surface such as a cabinet wall, and the present invention also provides an improved electrical bushing, which, when properly installed, provides numerous advantages as will be detailed herein.

As mentioned above, the bushing dielectric body 20 includes a pair of opposed, back-to-back frustoconical body portions 22, 24. The present invention is also applicable to many different types of electrical insulating bushings, such as the bushing 30 of FIGS. 3 and 4 which has a continuous conically-tapered insulating body 32, with first and second body portions 34, 36 disposed on either side of a radially outwardly extending flange 38. The insulating body 32 has an internal bore with a side wall 39 to accommodate an axial metallic conductor such as the type described above with reference to FIG. 1.

Figure 5:
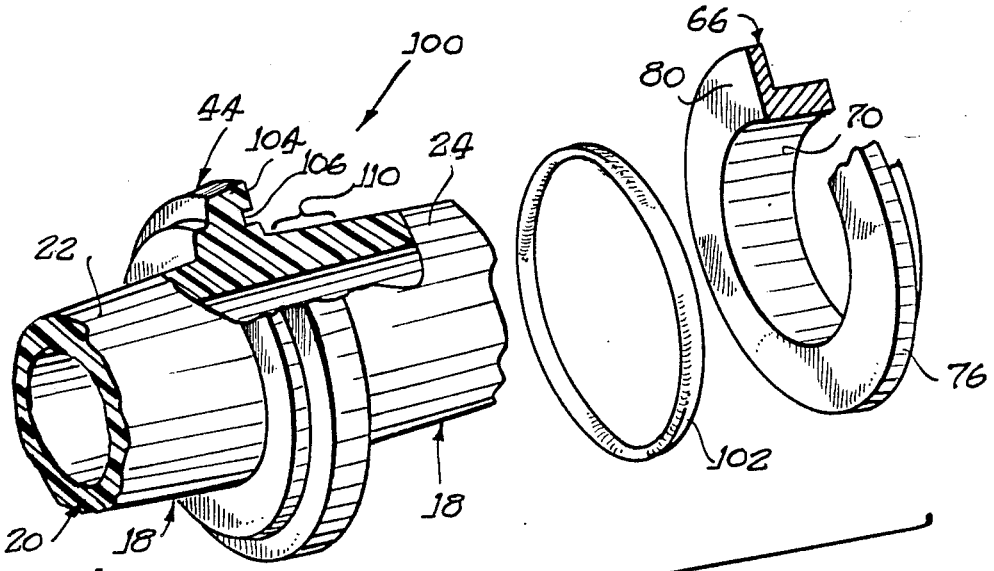
FIG. 5 is a fragmentary perspective view, shown partially broken away, of an alternative bushing assembly.
Figure 6:
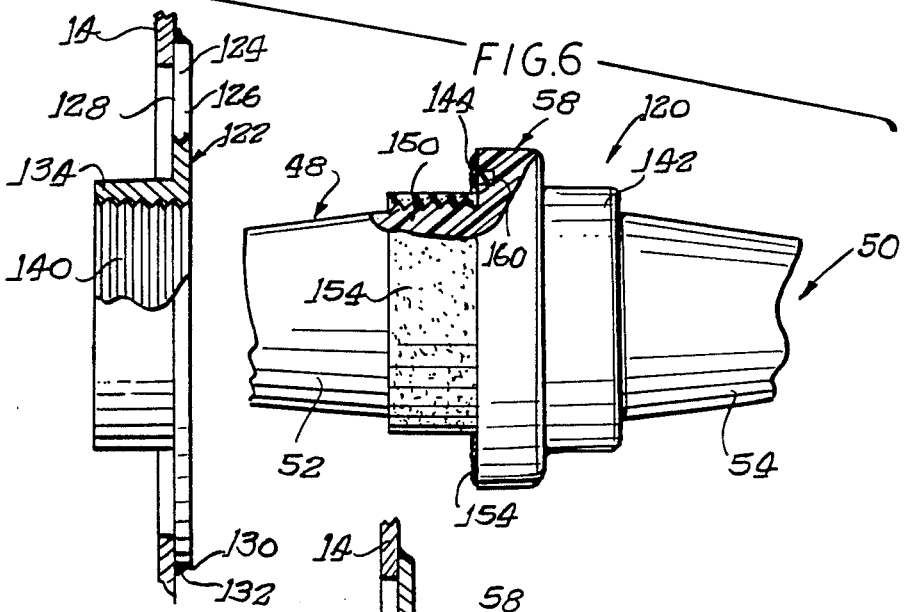
FIG. 6 is a fragmentary elevational view, shown partially broken away, of another alternative embodiment of a bushing assembly.

Briefly, FIG. 5 shows the aforementioned bushing 20 in greater detail, and, as a prominent feature, includes interior and exterior frustoconical body portions 24, 22, respectively, disposed on either side of a radially outwardly extending flange generally indicated at 44. FIG. 6 shows an alternative embodiment of the mounting bushing, generally indicated at 48, which includes an electrical insulating body 50 having opposed frustoconical portions 52, 54 disposed back-to-back on either side of a central mounting flange 58.

As will be seen, the various embodiments of the electrical bushing and their methods of installation provide different arrangements for securing the bushing insulating body to a mounting surface, such as a wall of an equipment cabinet, during fabrication of the bushing assembly As mentioned above, cabinet 12 provides a fluid-tight containment. Practical electrical devices, no matter how efficient, suffer resistance heating losses, thus subjecting the device and the bushing to a temperature rise during the operation of the device when a current is passed therethrough. Accordingly, many manufacturers of electrical devices prefer to surround the internal electrical component with a dielectric heat transfer medium, preferably in the form of a fluid, such as a liquid or a gas. As will be readily recognized by those skilled in the art, a dielectric gas must be maintained at an elevated pressure in order to provide an effective heat transfer from the internal electrical component to the cabinet surrounding the component, and thence to the surrounding environment. Also, while liquid dielectric fluids are usually not maintained at elevated pressures during assembly of the electrical device, heating of the fluid during operation of the device will result in an elevated pressure within the device cabinet. Accordingly, manufacturers of electrical equipment have paid considerable attention to the pressure-free leak containment of their equipment cabinets, and of the components protruding therethrough, such as the electrical insulating bushings referred to above.

Many of the dielectric fluids in use today are susceptible to leaking past all but the most perfect pressure-tight seals. Frequently, the terms "light" or "thin" are employed to describe this characteristic, indicating that seals and sealing methods otherwise adequate for heavier or more viscous fluids might not be adequate to contain the dielectric fluids.

Many different types of fluid-filled devices in use today have a relatively short life-span, or require periodic maintenance, and accordingly, the required fluid levels can be replenished during a maintenance operation. Unlike such equipment, fluid-filled high voltage electrical devices, particularly those employed in the electrical utility industry, have much longer life expectancies, typically of the order of forty years or more and are expected to require little or no maintenance over their useful life.

Accordingly, even very small leaks, barely detectable in other, less demanding applications, can result in a serious reduction in fluid volume over the life of the equipment. For example, manufacturers of equipment used in the electrical utility industry are concerned with minor leaks, so-called "fine" leaks on the order of $1\times10^{-6}$ cubic centimeter-atmospheres per second. Accordingly, manufacturers of electrical equipment of this type have had to pay careful attention to the smallest details of their pressure-confining cabinets and to components protruding therethrough which might compromise the leak-free integrity thereof.

As mentioned above, the bushings typically include a major body portion of electrical insulating or dielectric material surrounding a central electrical conductor. Electrical connection to external electrical components is made with relatively heavy electrical conductors such as cables or the like, which apply significant loading forces to the terminals of the bushings. Accordingly, the electrical insulating bushings must be mounted to the equipment cabinet in a manner which easily supports these loading forces without causing deflections of the bushings, a consideration especially important for high density, i.e. compact electrical device designs in which the bushings are arranged in closely-spaced arrays.

Several manufacturers have found it convenient to provide the electrical bushings with a metallic mounting collar associated with the mounting flange located generally at the center of the bushing body. The mounting collar and bushing are formed offsite as a completed subassembly which is thereafter brought to the location of fabrication of the electrical device. The cabinet of the electrical device is provided with a series of apertures such as the aperture 62 illustrated in FIG. 1, through which a portion of the bushing body is passed. One end of the bushing body is telescopically inserted through the cabinet aperture until the mounting flange and, in this particular instance, the mounting collar is brought into contact with the cabinet side wall defining the edge of the aperture. The mounting collar is then welded at its outer periphery to the metallic cabinet wall.

Those familiar with welding operations will appreciate that the bushing insulating body can be subjected to relatively high temperatures during the course of the welding operation. In fact, manufacturers of electrical devices which weld a completed bushing to a cabinet wall have noticed that the bushings are frequently adversely affected, particularly in their ability to provide a leak-free pressure containment. In order to reduce the adverse effect on the pressure-containing ability of the bushing, a heat sink is preferably employed at the location on the bushing insulating body immediately adjacent the mounting collar. As those skilled in the art will appreciate, the mounting collars are spaced at relatively close distances relative to the insulating body and, accordingly, it is difficult and time-consuming to locate the heat sink so as to provide adequate, protection against heat induction and associated temperature rise in the dielectric material, thereby protecting the bushing against degradation of its pressure-containing ability.

Despite such precautions, such welded bushings have been found to have significantly high failure rates when tested for fine leaks. Although the details of such degradation to the bushing are not completely understood at this time, the interface between the metallic mounting collar and the dielectric bushing flange is believed to be impaired when subjected to the heat induction associated with a welding operation, as discussed above. Fine leaks are believed to travel through the interface between the mounting collar and the bushing flange, thus finding a path to the surrounding atmosphere. However, as has been pointed out above, a welded attachment of a bushing to a metallic cabinet wall offers significant advantages such as cost savings during electrical device assembly and also provides a rugged, mechanically strong support for the bushing terminals which are cantilevered from the mounting flange.

As will now be seen, the present invention provides a relatively thinner and therefore more flexible metal interface for mounting a bushing to a cabinet wall, with a welded joinder of the flexible metal interface to the component-enclosing cabinet while entirely eliminating an associated heat induction and temperature rise in the dielectric bodies secured to the collar. The present invention has been found to be particularly advantageous in providing permanent bushing mountings, which remain satisfactory throughout the service life of the electrical equipment within the cabinet.

Further, the interface collar, two-piece interface assembly and the like bushing mountings and bushing apparatus provided by the present invention, as well as methods of installation in an electrical device associated therewith, are relatively inexpensive, providing cost savings for an electrical equipment manufacturer, and are particularly suitable for use with high density electrical devices in which a number of bushings are spaced together in a relatively close-fitting array. For example, as will be appreciated by those skilled in the art, the welding of a completed bushing to a cabinet side wall requires sufficient spacing for welding equipment to traverse the entire periphery of the mounting collar.

As can be seen in FIG. 1, for example, due to the relatively long extent of the bushing protrusion beyond the cabinet side wall, and the relatively close spacing of the bushing centers, it is difficult if not impossible to move fully-automated or even semi-automated welding equipment between the bushings so as to weld opposing portions of the bushing mounts. With the present invention, the bushing mounts are welded to the cabinet side wall before the bushing-insulating body is attached thereto. The relatively low profile or minimal protrusion of the novel bushing mounts beyond the cabinet wall surface provides significant labor savings during the welding operation.

Figure 3:
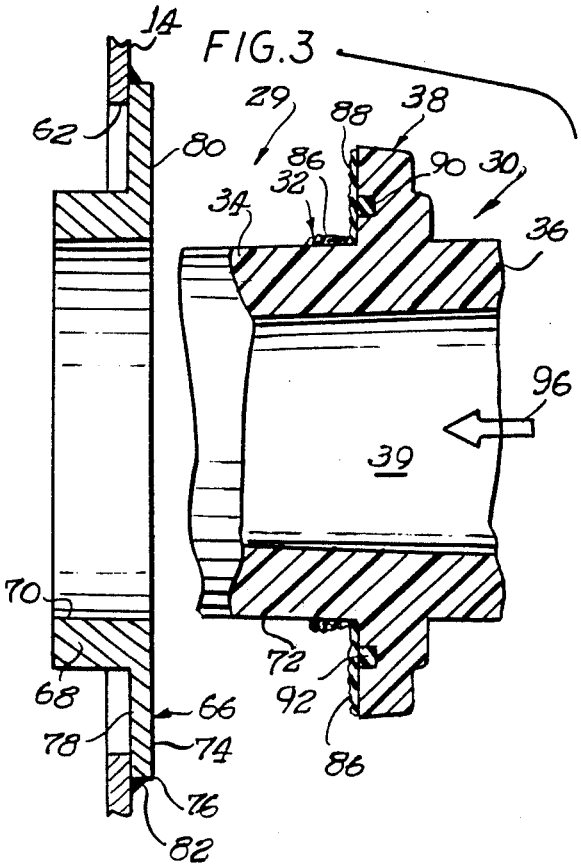
FIG. 3 is a fragmentary cross-sectional elevational view showing the installation of a bushing in the electrical device.
Figure 4:
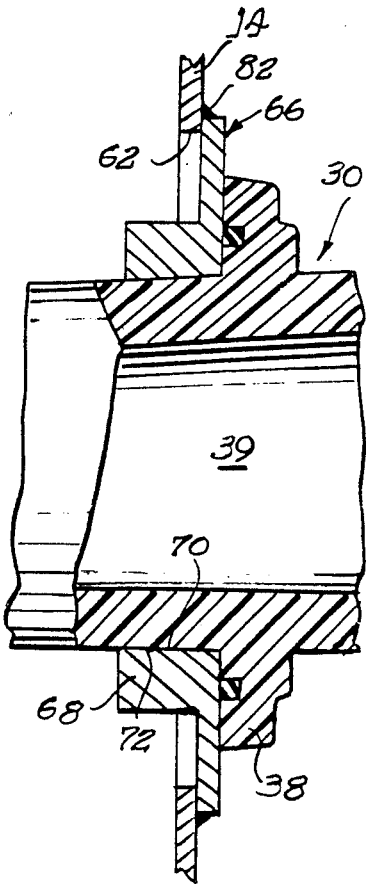
FIG. 4 is a fragmentary cross-sectional elevational view taken along the line 4—4 of FIG. 2, showing the bushing of FIG. 3 installed in the electrical device.

Referring now to FIGS. 3–4, the bushing assembly according to the present invention is generally indicated at 29. The assembly 29 includes a bushing mount in the form of a metallic flexible interface collar, hereinafter "interface collar," generally indicated at 66 having an axially-extending body portion 68, generally cylindrical in configuration, protruding into the aperture 62 of cabinet side wall 14. The body 68 of the interface collar includes an internal aperture or side wall 70 which preferably is conically tapered to complement the configuration of the outer surface portion 72 of first bushing portion 34, immediately adjacent the mounting flange 38.

The interface collar 66 further includes an outer flange 74 having an outer periphery 76 and a surface 78 facing the outer surface of cabinet side wall 14 so as to be placed in contact therewith, in the manner illustrated in FIG. 3. The mating surface 78 opposes the outer surface 80 of flange 74, that surface visible from the outside of cabinet 12 after the bushing is installed. As illustrated in FIG. 3, the flange 74 overlies the outer surface of cabinet side wall 14 and the periphery 76 thereof is welded to the cabinet side wall at 82. The flange 74 is thinner than the cabinet sidewall to which it is welded, so as to be more flexible than the sidewall. Alternatively, the flange 74 can be made of a material which achieves a similar increased flexibility, despite a greater thickness. The relative flexibility of the flange 74 helps to maintain the pressure-tight and fluid-tight seal to the bushing and cabinet, despite "oil-canning" and other deformations of the cabinet sidewall, due to pressure variations within the cabinet. The flexibility of the interface collar also prevents the transmission of forces to the bushing, caused by cabinet expansion and contraction, which could crack or otherwise degrade the integrity of the bushing structure.

The welded joinder 82 is constructed according to conventional welding techniques which are suitable for forming a fluid-tight bond with a continuous impermeable barrier completely enclosing the aperture 62 so as to render cabinet 12 leak-free, preferably with respect to fine leaks. As can be seen, the thickness of the flange 74, that distance between the opposed major surfaces 78, 80 thereof, is relatively insignificant compared to the full axial extent of bushing 30 and especially that portion 36 of bushing 30 protruding outwardly beyond the outer surface of cabinet side wall 14. This feature permits the ready access of welding equipment, particularly automated equipment, to the weld seam joining the interface collar and cabinet wall.

The first portion 34 of bushing 30 is inserted into the internal bore of interface collar 66 after the interface collar is welded to the cabinet side wall 14. Preparatory to the insertion of bushing portion 34, the outer surface portion 72 thereof and the mating face of the bushing flange 38 are coated with a suitable adhesive 86 for continuous leak-free joinder with the outer surface 80 and internal wall surface 70 of the interface collar 66. The preferred adhesive comprises a fast curing, anaerobic adhesive of the type commercially available from the LOCTITE Corporation and commercially available therefrom under the description SPEEDBONDER 326 Adhesive. As mentioned above, the dielectric body of bushing 30 has a continuous conical taper defined at an outer surface of the bushing which includes the aforementioned surface portion 72, for example. This preferred configuration provides a close fitting wedging engagement between the interface collar inner bore and the bushing.

While in most applications the adhesive coating 86 may alone be sufficient to provide the requisite leak-free joinder between the bushing and interface collar, it is generally preferred that a resilient gasket be employed. In the preferred embodiment, the mating face 88 of bushing flange 38 is provided with a recessed annular groove 90 so as to receive a gasket ring 92 therein. As illustrated in FIG. 3, the gasket ring 92 has a generally rectangular cross section. However, circular cross section gasket rings 92 and gasket rings of other configurations can also be used if desired.

After inserting the gasket ring 92 in recess 90, the adhesive coating 86 is applied to the bushing mounting flange and side wall portion 72. Thereafter, the bushing portion 34 is telescopically inserted in the interface collar 66, in the general direction of arrow 96. The bushing mounting flange 38 is maintained in contact with the outer interface collar face 80 with a preselected minimum pressure, applied to the bushing or alternatively to the mounting flange thereof, in the direction of arrow 96. Pressure is preferably maintained until the adhesive coating 86 has fully cured so as to achieve a preselected minimal strength sufficient to support the bushing 30 in a free standing manner.

A variety of conventional techniques can be employed to maintain the bushing flange in contact with the interface collar while the adhesive cures. It is generally preferred that the cabinet side wall 14 not be penetrated by the clamping arrangement. Accordingly, the preferred manner of applying requisite pressure to the bushing and bushing mounting flange is to provide a support wall opposite the cabinet side wall 14 against which a pressure force in the direction of arrow 96 may be developed against the bushing flange 38.

For example, a plate of rigid material, such as a sheet of plywood, with apertures for receiving the outwardly protruding portions 36 of the bushings can be inserted over the array of freshly installed bushings and the device 10 can be positioned so that the side wall 14 is located proximate a support surface such as a building wall. A series of hydraulic jacks or other pressure-generating means can be inserted between the support wall and the rigid plate, so as to generate the requisite pressure on each bushing and preferably the mounting flange thereof in bushing axial directions extending toward the interior of cabinet 12. Other means for generating the pressure on an adhesively coated bushing can also be employed and a number of alternative clamping arrangements will become immediately apparent to those skilled in the art.

After the adhesive is cured, the bushing assembly 29 enjoys a heretofore unattainable leak-free seal, with an adhesive joinder over the bushing surface portion 72 and the mounting flange surface 88, together comprising a relatively long path length whose leak resistant properties are easily controlled in a cost-effective manner. As an important feature of the present invention, heat induction and subsequent, seemingly inevitable damage to the leak-free seal is completely avoided.

Welded bushing constructions offer a number of advantages, as has been pointed out above. Such welded bushings heretofore available have welding flanges extending into the bushing insulator body so as to be embedded therein for secure mechanical engagement therewith. These bushings have been formed under pressure to ensure a close bond with reduced voids which might subsequently develop a leakage path when the electrical equipment is pressurized. Unlike these prior art bushings, the bushing according to the present invention achieves a superior joinder of the welding mount and bushing insulator body without requiring the welding mount to invade the insulator material surrounding the high voltage conductor served by the bushing. Tests on bushing designs according to the present invention have indicated as much as a 50% reduction in dielectric stress at points adjacent the welding mount. As will be seen, the welding, mount can include a two-piece assembly of a welding disk and a bushing-engaging mounting ring, as well as the aforementioned interface collar. Referring now to FIG. 5, an alternative bushing assembly is generally indicated at 100. The bushing assembly 100 is similar to the assembly 29 of FIGS. 2–4 except for the configuration of the gasket seal 102 which is generally cylindrical in configuration, and the configuration of the bushing dielectric body 20 which has opposed frustoconical portions 22, 24. Other features of the bushing assembly 100 are similar to the aforedescribed assembly illustrated in FIGS. 2–4. For example, the bushing 18 has a generally cylindrical collar-like mounting flange 44 with a mating face 104 defining a recess 106 for receiving the gasket 102. The interface collar is substantially identical to interface collar 66 of the preceding figures, and accordingly bears the same reference numeral.

The bushing assembly 100 is illustrated in FIG. 5 in an exploded view, prior to installation of the assembly into an electrical device. As with the preceding bushing assembly 29, the interface collar 66 of assembly 100 is first fitted to and thereafter welded at its peripheral edge 76 to a device side wall. The gasket 102 is then fitted in the flange recess 106 and a suitable adhesive is applied to the surface portion 110 of the bushing interior end 24 and to the mating face 104 of flange 44. The interior end 24 of the bushing is then inserted in the central aperture of the interface collar 66 until the mating face 104 is brought into contact with the major face 80 of the interface collar.

Preferably, the surface portion 110 of the bushing is pressed into engagement with the side wall 70 of the interface collar, but such may be omitted if desired. The mating engagement is generally preferred in that the path length of a leakage through the joined area is substantially lengthened, thereby reducing the possibility that a leakage path might be formed at the adhesively-joined surfaces. The mounting flange of the bushing can be pressed against the interface collar by any suitable means, such as those described above.

Figure 7:
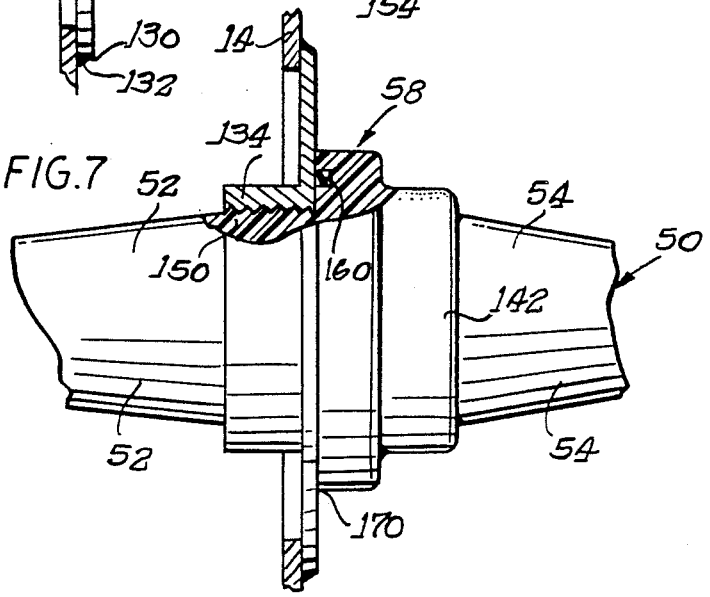
FIG. 7 is a side elevational view, partially broken away the bushing of FIG. 6 fully installed in the electrical device.

Referring now to FIGS. 6–7, a further alternative bushing assembly is generally indicated at 120. The bushing 48 of the assembly comprises opposed frustoconical portions disposed on either side of a mounting flange 58. The bushing assembly 120 is characterized, in one aspect, by an alternative interface collar generally indicated at 122 having a flange 124 with a mating face 126 and an opposed interior face 128 contacting the outer surface of cabinet side wall 14. The outer periphery 130 of the flange is welded at 132 through the cabinet side wall. The central cylindrical body portion 134 of the interface collar is similar to the body portion 68 described above, but differs therefrom by having a threaded internal bore 140.

Figure 2:
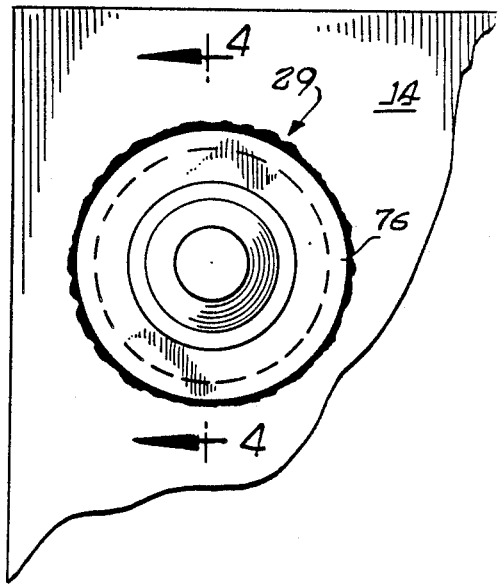
FIG. 2 is a fragmentary elevational view of the electrical device of FIG. 1 showing an end view of an electrical bushing according to the invention installed therein.

The general shape and relative size of the mounting flange 58 of bushing 48 differs from the mounting flange 38 illustrated in FIGS. 2–4 (note the enlarged portion 142), but such differences are, generally speaking, not important to the preferred assembly of the bushing, as long as the mating face 144 of flange 58 is sufficiently large so as to provide a secure joinder to the outer face 126 of the interface collar 122.

Prior to mating of the bushing with the interface collar, a coating 154 of a suitable adhesive is applied to the bushing flange mating face 144 and to the external threaded portion 150. Prior to assembly, a gasket 160 is inserted in a suitable recess formed in the mating, face 144 of the bushing. With the adhesive applied, the bushing is threadingly engaged with the threaded bore of the interface collar and is advanced until a desired contact pressure between the mating face 144 of the bushing flange and the outer face 126 of the interface collar is obtained. One advantage of the bushing assembly 120 is that an installation thereof in an electrical device can be completed without requiring a clamping fixture or the like.

As is apparent from FIG. 7, the completed bushing assembly includes a continuous airtight and watertight joinder between the outer corner of the bushing flange and the exterior surface of the interface collar, the area herein denoted by the reference numeral 170. Thus, intrusion of water and/or contaminants into the joint between the bushing and the interface collar is prohibited.

Figure 8:
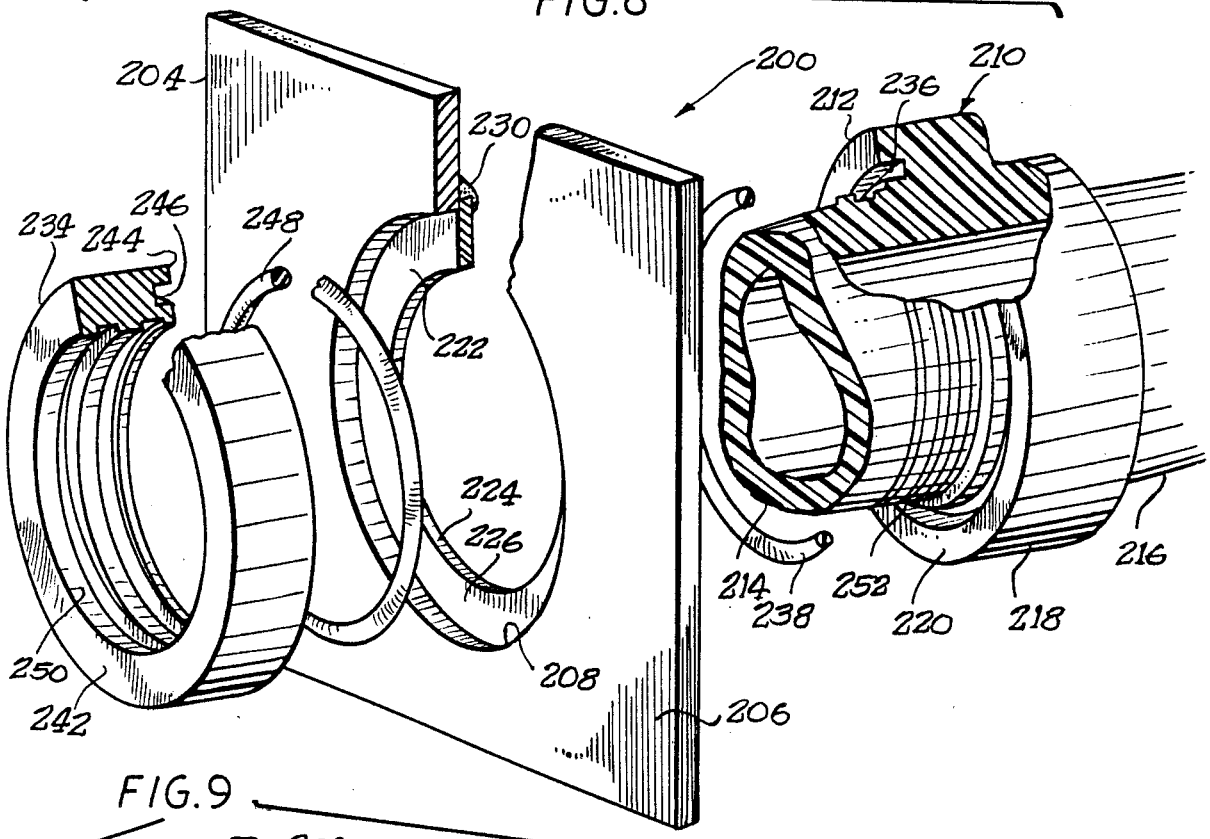
FIG. 8 is an exploded perspective view, partially broken away, of an alternative bushing assembly according to principles of the present invention.
Figure 9:
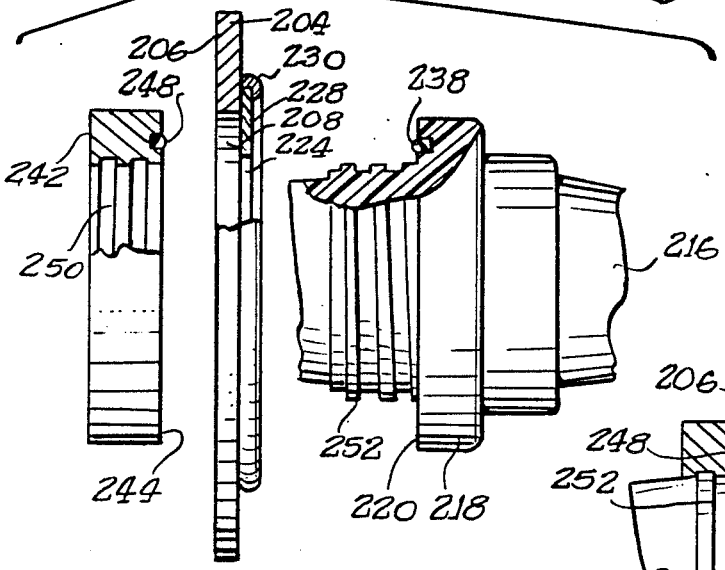
FIG. 9 is an exploded side elevational view, partially broken away, of the assembly of FIG. 8.
Figure 10:
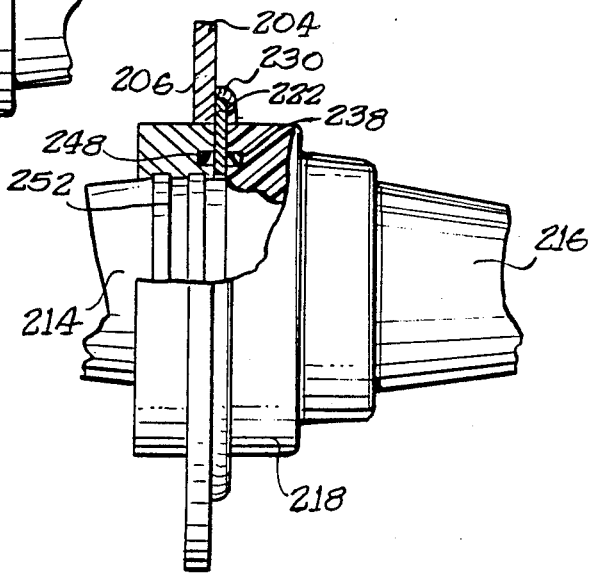
FIG. 10 is a side elevational view, partially broken away, of the arrangement of FIG. 9, shown in a fully assembled condition.

Referring now to FIGS. 8–10, an alternative embodiment of a bushing assembly is generally indicated at 200. A sidewall 204 of an equipment cabinet provides an enclosure for an electrical device such as a transformer or a switch gear. The exterior surface 206 of the wall is visible in FIG. 8 and, in the preferred embodiment, the electrical bushing is inserted from within the enclosure. The sidewall 204 defines a central aperture 208 for receiving a bushing 210. The bushing includes an insulating body 212, similar to the insulating body 50 described above with reference to FIGS. 6 and 7. The insulating body includes first and second generally conical portions 214, 216 the former extending outwardly of the enclosure, and the second disposed within the enclosure. Intermediate the body portions 214, 216 is an outwardly extending flange 218. The flange 218 has a mating face 220 to engage the interior surface of a mounting disk.

The mounting disk for mounting the bushing is indicated by the reference numeral 222 and generally comprises an annular flat disk, preferably having a generally rectangular cross-section. The mounting disk defines an interior bushing-receiving aperture 224 for receiving the bushing body portion 214. The mounting disk 222 also includes an external surface 226 and an internal surface 228 (see FIG. 9). The outer periphery of mounting disk 222 is welded at 230 to the interior surface of wall 204. As indicated in FIG. 8, the aperture 224 of mounting disk 222 is considerably smaller than the aperture 208 formed in wall 204. The difference of the sizes in the mounting disk and enclosure wall apertures provides a close fit recessed seating for a mounting ring 234, which will be described below.

In use, the mounting disk 222 is welded to the enclosure wall 204 from the interior of the closure, and is particularly suitable for installation by an equipment manufacturer who forms pressure-tight enclosures by welded joinder of the various wall panel components thereof. As with the foregoing embodiments of the present invention, the weld mounting has a narrow profile so as to provide efficient access during the welding operation, even in high density, closely spaced applications.

Referring again to FIG. 8, the bushing flange 218 has an annular recess 236 formed in the mating face 220 thereof. The annular recess at least partly receives a resilient, annular gasket 238 which preferably comprises an "O-ring" of suitable material resistant to the dielectric insulation material disposed within the equipment enclosure. The gasket 238 is preferably coated with an anaerobic adhesive, such as that described above, and is seated within recess 236. The bushing and gasket is thereafter telescoped in an outward direction, with body 214 passing through the aperture 224 in the mounting disk. Insertion of the bushing is continued until the gasket 238 is pressed between the inner surface 228 of the mounting disk and the recess 236 of the bushing flange.

Referring again to FIG. 8, the mounting ring 234 has an exterior surface 242 and an opposed internal surface 244. An annular recess 246 is formed in the interior surface 244 so as to at least partly receive a resilient annular gasket 248 which also preferably comprises an "O-ring" of suitable material. The mounting ring 234 has a threaded internal aperture 250 dimensioned to receive the bushing body part 214. The threads on the internal aperture of mounting ring 234 matingly engage with external threads 252 formed on body portion 214, adjacent the flange 218 thereof, and in particular adjacent the mating face 220 thereof. With the bushing fully inserted through the aperture 224 in the mounting disk, to the position illustrated in FIG. 10, the threaded portion 252 of the bushing protrudes beyond the outer mounting disk face 226. An anaerobic adhesive is preferably applied to the gasket 248 and/or to the recess portion 246 of the mounting ring, in addition to the internal face 244 of that mounting ring. An adhesive is also applied to the threaded portion 252, and the gasket and mounting ring are then applied to the bushing body portion 214.

With subsequent rotation of mounting ring 234, the mounting ring becomes threadingly engaged with the bushing threaded portion 252 and gasket 248 becomes compressed against the external surface 226 of the mounting disk. As the mounting flange is threadedly advanced, the pressure of the mating face 220 of the bushing flange against, the interior surface 228 of the mounting disk, and the compression of gasket 238 may also be increased to a desired level. The bushing assembly thereupon takes on the configuration illustrated in FIG. 8, wherein the mating faces 220, 244 of the bushing flange and mounting ring are compressed against surfaces of the mounting disk , and with resilient gaskets 238, 248 also compressed against the mounting disk. The adhesive is thereupon allowed to cure to form a permanent bond among the mated surfaces, as will be described in greater detail below, so as to provide a number of redundant leak-free gas-tight seals so that any pressurized gas or liquid dielectric material within the enclosure is not allowed to escape to the atmosphere.

As illustrated in FIG. 10, the aperture 208 of wall portion 204 is dimensioned so as to closely receive the mounting ring 234 with a relatively tight fit about the outer surface thereof. The interface between mating face 244 of the mounting ring and the external face 226 of the mounting disk is thereby shielded by the wall panel to reduce the intrusion of contaminants to that interface. If desired, a suitable adhesive such as the anaerobic adhesive described above may be applied to the internal surface of wall 204 which forms aperture 208 or to the external surface of mounting ring 234, so as to provide a leak-tight seal against intrusion to the interface between the mounting ring and mounting disk.

In the preferred embodiment of the alternative bushing assembly illustrated in FIG. 10, a redundant seal is provided to prevent leakage of a pressurized gas to the atmosphere. Any pressurized gas or liquid within the enclosure that might migrate between the adhesively joined surfaces 220 of the bushing flange and the internal surface 228 of the mounting disk is stopped by the gasket, 238. In addition thereto, a number of seals are located downstream of the gasket 238. For example, the threaded portion 252 of the bushing is adhesively joined to the mounting ring 234 with a leak-tight anaerobic adhesive joinder. In addition, the mating face 244 of the mounting ring is adhesively joined to the external surface 226 of the mounting disk also with a leak-tight joinder. Finally, the gasket 248 is compressed against and adhesively joined to the external surface of the mounting disk, and the outer portion of the mounting ring mating face 244 is also adhesively joined to the mounting disk face 226, to form a leak-tight joinder. Thus, the bushing assembly is protected against leakage in a number of different ways.

As mentioned above, the resilient gaskets 238, 248 provide redundant leak-tight seals about the mounting disk. In the preferred embodiment, the resilient gaskets 238, 248 are of generally the same size, and are coaxially aligned, so as to oppose one another in the manner illustrated in the cross-sectional view of FIG. 10. This arrangement has been provided to achieve an optimum application of pressure force to the resilient gaskets. As indicated above, a plurality of redundant leak-free seals is provided at the various surfaces of the bushing assembly which are adhesively joined together. If desired, one or both gaskets 238, 248 can be eliminated, if desired, since the leak-free joinder of the mating surfaces joined together with an anaerobic adhesive has been found to provide a permanent, reliable seal, even against fine leaks.

As can be seen from the above, the present invention provides an electrical insulating bushing and a method of installation of the bushing in an electrical device which allows an improved welding of a mounting ring to a cabinet wall of the device. The welding is improved in one aspect in that a sufficient amount of heat can be applied to the interface collar without fear of compromising the pressure seal of the bushing associated therewith. In another aspect, the welding can be performed by automated or semi-automated equipment or welding equipment which is otherwise large or bulky, particularly for high density arrays of bushings, as is becoming increasingly popular with electrical equipment manufacturers. The present invention also provides an opportunity for testing the welded joinder prior to further assembly of the bushing and, if the welding should prove to be unacceptable, the cost of replacing the bushing can be saved by an equipment manufacturer. Frequently, the only adjustment that needs to be required is that the interface collar be rewelded and, thus, no additional material costs are incurred.

As pointed above, the present invention eliminates the risk of heat damage to the bushing components since the bushing dielectric body is associated with the interface collar only after welding thereof has been completed.

Further, unlike bushings having an interface collar associated therewith during their manufacture, bushings used in the present invention can be cast or otherwise molded by a process not requiring a pressure molding. Thus, a wide variety of materials can be used in forming the bushing body. In addition, the bushing and method according to the present invention allow the interface collar to be painted after welding so as to prevent corrosion of the exposed surfaces thereof when exposed to the elements. The interior surfaces of the interface collar, those surfaces covered after assembly, are also coated with adhesive, which also provides an effective barrier against corrosion. It is generally preferred that the interior surfaces of the interface collar be maintained free of paint and the like, so that the adhesive bonds directly to the metal surface of the collar. According to one aspect of the present invention, the metal surface acts as a catalyst for curing the preferred anaerobic adhesive described above.

Several modifications and alternative arrangements of the bushing and its method of installation are possible. For example, the preferred manner of providing a fluid-tight seal is to provide a compressible gasket between the bushing mounting flange and the interface collar and compress the gasket during bushing assembly. If desired, however, the mounting flange of the bushing can be eliminated, with the fluid-tight joinder between the interface collar inner bore and the outer surface of the bushing being relied upon to provide the desired fluid-tight seal. If desired, a compressible gasket can be installed between the bushing outer surface and the interface collar inner bore. An annular recess in the bushing outer surface may be provided for this purpose. This latter arrangement is particularly useful for bushings having a threaded outer surface, for mating with an internal threaded bore of the interface collar, the bushing and collar being conically tapered for a complementary wedge fitting. The gasket could be located in or immediately adjacent the fitted portion of the bushing so that, with threaded advancement of the bushing relative to the interface collar, the gasket will become wedged against the inner bore of the collar so as to augment the field of the adhesive joinder. Of course, the same gasket arrangement could be used with an insulator bushing and a interface collar having smooth mating surfaces, particularly surfaces which are complementarily shaped for a wedge fit. If desired, a recess could be provided in the interface collar inner bore to help locate and seat an annular gasket as the interface collar is wedgingly mated with a bushing body.

Those skilled in the art will readily appreciate that the apparatus of the above bushing assemblies and their method of installation could be utilized as a field-installed kit, especially where a less exacting sealing is required. It is, however, generally preferred that the bushings be installed in a controlled environment during manufacture of the electrical device in order to ensure that the resulting fluid-tight seal will be formed with a high degree of reliability, and will provide the desired performance over the expected life of the device, without requiring maintenance or further attention.

A description of the present forms of the invention having been given by way of example, it is anticipated that variations of the described forms of the apparatus may be made without departing from the invention and the scope of the appended claims.

What is claimed is:

1. A method of installing an electrical insulating bushing in an electrical device having at least one outer metallic wall defining a bushing-receiving aperture, comprising the steps of:

providing a bushing having a body with opposed ends and electrical terminals at each end;

providing an external flange of electrical insulating material outwardly extending from said bushing body and located intermediate the ends thereof;

providing a metallic interface collar with a mating face for engaging said bushing external flange and an internal wall defining an aperture for telescopically receiving a portion of the bushing;

welding said interface collar to said device wall;

providing an annular gasket;

coating adhesive on at least one of said bushing and said interface collar;

inserting said gasket between said bushing flange and said interface collar;

inserting one end of said bushing through said interface collar;

pressing said bushing flange against said interface collar to compress said gasket therebetween to join said bushing and said interface collars together and to form a fluid-tight seal therebetween; and allowing said adhesive to cure so as to maintain the joinder and the fluid-tight seal between said bushing flange and said interface collar.

2. The method of claim 1 wherein the steps of providing said bushing and said external bushing flange comprises the step of concurrently casting said bushing and said bushing flange with a liquid casting material to form a unitary bushing body having said bushing flange.

3. The method of claim 2 wherein said casting step comprises the step of continuously tapering the outer surface of the bushing by casting the liquid material in a tapered mold.

4. The method of claim 3 further comprising the step of forming an inside wall in said interface collar tapered with a taper corresponding to the taper of the bushing body so as to have a complementary close-fit engagement therewith when the bushing is telescoped therein.

5. The method of claim 2 further comprising the steps of forming a recess in said external flange opposite said interface collar and disposing said gasket at least partly in said recess so as to orient said gasket during said pressing step.

6. The method of claim 1 further comprising the steps of dimensioning said interface collar aperture for a close fit with a portion of said bushing body intermediate the ends thereof and coating adhesive on said bushing body portion so as to adhesively join said bushing body portion and said interface collar internal wall.

7. The method of claim 6 further comprising the steps of coating adhesive on at least one of said interface collar mating face and said bushing external flange.

8. A method of installing an electrical insulating bushing in an electrical device having at least one outer metallic wall defining a bushing-receiving aperture, comprising the steps of:

providing a bushing having opposed ends and terminals at each end;

providing external threads on at least a portion of said bushing outer surface intermediate the ends of the bushing;

providing an external flange of electrical insulating material, outwardly extending from said bushing and located intermediate the ends thereof;

providing a metallic interface collar with a mating face opposite said bushing flange and an internal wall, and forming threads on said internal wall for engaging the threaded portion of the bushing;

welding said interface collar to said device wall;

providing an annular gasket;

coating adhesive on at least one of said bushing and said interface collar;

inserting said gasket between said bushing and said interface collar;

inserting one end of said bushing through said interface collar;

threadingly engaging said flange and said bushinq outer portion so as to compress said gasket therebetween to form a fluid-tight seal therebetween while joining said bushing and said interface collar together; and allowing said adhesive to cure so as to maintain the joinder and the fluid-tight seal between said bushing flange and said interface collar.

9. The method of claim 8 wherein the adhesive coating step comprises the step of coating at least one of said bushing threaded portion and said interface collar internal threads.

10. The method of claim 9 further comprising the steps of coating adhesive on at least one of said interface collar mating face and said bushing external flange.

11. The method of claim 8 wherein the steps of providing said bushing and said external bushing flange comprises the step of concurrently casting said bushing and said bushing flange with a liquid casting material to form a unitary bushing body having said bushing flange.

12. The method of claim 11 wherein said casting step comprises the step of continuously tapering the outer surface of the bushing by casting the liquid material in a tapered mold.

13. The method of claim 12 further comprising the step of forming an inside wall in said interface collar tapered with a taper corresponding to the taper of the bushing body so as to have a complementary close-fit engagement therewith when the bushing is telescoped therein.

14. The method of claim 8 further comprising the steps of forming a recess in said external flange opposite said interface collar and disposing said gasket at least partly in said recess so as to orient said gasket during said pressing step.

15. A housing assembly for an electrical component comprising:

a closure for at least partly enclosing an electrical component immersed in a dielectric fluid and said closure having an external metallic wall defining an aperture through which an electrical insulating bushing can be inserted;

an electrical-insulating bushing having a body with opposed ends, one of which is disposed within said closure and electrical terminals at each end;

a metallic interface collar having an internal wall defining a central bushing-receiving passageway, a mating face and an opposed closure-engaging face, said collar welded to said closure metallic wall;

a flange of insulating material outwardly extending from the bushing and pressed against said interface collar;

a resilient gasket between said bushing flange and said interface collar;

a first portion of said bushing extending through said interface collar and said metallic wall; and said bushing flange and said interface collar being adhesively joined together so as to maintain a compression of said gasket between said bushing flange and said interface collar mating face and so as to form a fluid-tight seal therebetween.

16. The assembly of claim 15 wherein said bushing flange includes recess walls inwardly extending from said mating face forming a recess for at least partly receiving said gasket so as to orient said gasket during compression thereof.

17. The assembly of claim 15 wherein the first portion of said bushing includes an outer tapered surface and said interface collar internal wall is tapered for a complementary close-fit engagement therewith with the first portion of the bushing body when telescoped therein.

18. The assembly of claim 17 further comprising an adhesive joinder between said bushing body first portion and said interface collar internal wall for a fluid-tight joinder therebetween.

19. The assembly of claim 18 further comprising an adhesive joinder between said interface collar mating face and said bushing external flange for a fluid-tight seal therebetween.

20. The assembly of claim 15 wherein said interface collar is L-shaped in cross-section, with one leg thereof comprising a mounting ring adhesively joined to the outer surface of said bushing.

21. A housing assembly for an electrical component comprising:

a closure for at least partly enclosing an electrical component and having an external metallic wall defining an aperture through which an electrically-insulating bushing can be inserted;

an electrical-insulating bushing having opposed ends and terminals at each end ;

a metallic interface collar welded to said closure metallic wall and defining a threaded bushing-receiving aperture;

one end of said bushing disposed within said closure and extending through said interface collar aperture;

a flange of insulating material outwardly extending from the bushing;

a resilient gasket between said bushing flange and said interface collar;

external threads on a first portion of said bushing adjacent said flange matingly engaged with the threads of said interface collar so as to press said bushing flange and said interface collar together;

said bushing extending through said interface collar and said metallic wall; and said bushing flange and said interface collar being adhesively joined together so as to maintain a compression of said gasket between said bushing flange and said interface collar and so as to form a fluid-tight seal therebetween.

22. The assembly of claim 21 wherein said bushing flange includes recess walls inwardly extending from said mating face forming a recess for at least partly receiving said gasket so as to orient said gasket during compression thereof.

23. The assembly of claim 21 wherein the first portion of said bushing includes an outer tapered surface and said interface collar internal wall is tapered for a complementary close-fit engagement therewith with the first portion of the bushing body when telescoped therein.

24. The assembly of claim 23 further comprising an adhesive joinder between said interface collar mating face and said bushing external flange for a fluid-tight seal therebetween.

25. The assembly of claim 21 further comprising an adhesive joinder between said bushing body first portion and said interface collar internal wall for a fluid-tight seal therebetween.

26. A housing assembly for an electrical component comprising:

a closure for at least partly enclosing an electrical component and having an external metallic wall defining an aperture through which an electrically-insulating bushing can be inserted;

an electrical-insulating bushing having opposed ends and terminals at each end;

a metallic mounting disk welded to said closure metallic wall and defining a bushing-receiving aperture;

one end of said bushing disposed within said closure and extending through said mounting disk aperture;

a flange of insulating material outwardly extending from the bushing;

a resilient gasket between said bushing flange and said mounting disk;

said bushing extending through said mounting disk and said metallic wall;

a mounting ring defining a bushing receiving aperture with internal threads for mating with threads on said bushing, and having a face for engaging said mounting disk when mounted to said bushing;

external threads on a first portion of said bushing adjacent said flange matingly engaged with the threads of said mounting ring so as to press said bushing flange and said mounting disk together; and said bushing flange and said mounting disk being adhesively joined together so as to maintain a compression of said gasket between said bushing flange and said mounting disk and so as to form a fluid-tight seal therebetween.

27. The housing assembly of claim 26 further comprising a second resilient gasket between said mounting ring mating face and said mounting disk.

28. The housing assembly of claim 27 wherein said mounting ring mating face defines a recess for receiving at least a portion of said second gasket.

29. The housing assembly of claim 27 wherein said first and said second gaskets are positioned to generally oppose one another when seated against said mounting disk.

30. The housing assembly of claim 26 wherein said closure defines a ring-receiving aperture for receiving at least a portion of said mounting ring.

31. The housing assembly of claim 30 wherein said mounting disk is positioned within said closure and said mounting ring faces outwardly of said closure.

32. A kit for providing an electrical-insulating bushing in an aperture of an external metallic wall of a fluid-containing enclosure of an electrical component immersed in a dielectric fluid, comprising;

a metallic interface collar for welding to portions of the outer metallic wall of the enclosure surrounding said aperture and having an internal bushing-receiving passageway with internal threads;

a bushing having an insulating body with opposed ends, electrically-conducting terminals at each end, an outwardly extending flange with a mating face intermediate the ends, a gasket-receiving recess in said flange extending from the mating face thereof, and external threads formed on an outside surface of said bushing intermediate the ends thereof and adjacent the flange thereof;

a resilient gasket dimensioned to be at least partially received in said flange recess; and an adhesive for joining the bushing flange and the interface collar together after welding of said collar to the enclosure wall, so as to form a fluid-tight seal therebetween.

33. The kit of claim 32 wherein said adhesive is anaerobic, being curable in the absence of air.

34. The kit of claim 32 wherein said bushing insulating body is formed by liquid casting.

35. A kit for providing an electrical-insulating bushing in an aperture of an external metallic wall of a fluid-containing enclosure of an electrical component immersed in a dielectric fluid, comprising;

a bushing having an insulating body with opposed ends, electrically-conducting terminals at each end, an outwardly extending flange with a mating face intermediate the ends, a gasket-receiving recess in said flange extending from the mating face thereof, and external threads formed on an outside surface of said bushing intermediate the ends thereof and adjacent the flange thereof;

a resilient gasket dimensioned to be at least partially received in said flange recess; and a metallic mounting disk for welding to portions of the outer metallic wall of the enclosure surrounding said aperture;

a mounting ring defining a bushing receiving aperture with internal threads for mating with the threads on said bushing so as to compress said resilient gasket, and said mounting ring having a mating face for engaging said mounting disk when said mounting ring is threadingly mated with said bushing; and an adhesive for joining the bushing flange and the mounting disk together after welding of said mounting disk to the enclosure wall, so as to form a fluid-tight seal therebetween.

36. The kit of claim 35 further comprising a second resilient gasket for positioning between said mounting ring mating face and said mounting disk, and said mounting ring mating face defining a recess for receiving at least a portion of said second gasket, said recess positioning said second gasket so as to generally oppose said one gasket when said gaskets are seated against said mounting disk.

* * * * *